US007467949B2

(12) United States Patent
Liao

(10) Patent No.: US 7,467,949 B2
(45) Date of Patent: Dec. 23, 2008

(54) LAND GRID ARRAY SOCKET

(75) Inventor: Fang-Jwu Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/728,779

(22) Filed: Mar. 27, 2007

(65) Prior Publication Data

US 2007/0224887 A1 Sep. 27, 2007

(30) Foreign Application Priority Data

Mar. 27, 2006 (TW) ..... 95205085 U

(51) Int. Cl.
*H01R 12/00* (2006.01)

(52) U.S. Cl. ..... 439/66

(58) Field of Classification Search ..... 439/66, 439/591, 862

See application file for complete search history.

(56) References Cited

U.S. PATENT DOCUMENTS 1,477,527 A * 12/1923 Raettig ..... 200/282
6,186,797 B1 * 2/2001 Wang et al. ..... 439/66
6,488,513 B1 * 12/2002 Neidich et al. ..... 439/66
6,540,526 B2 * 4/2003 Toda ..... 439/66
6,843,659 B2 * 1/2005 Liao et al. ..... 439/66
7,150,632 B2 * 12/2006 Lee et al. ..... 439/66
7,156,706 B2 * 1/2007 Brown et al. ..... 439/862
2002/0081870 A1 * 6/2002 Toda ..... 439/66
2004/0192081 A1 * 9/2004 Koopman et al. ..... 439/66
2005/0020146 A1 * 1/2005 McAlonis et al. ..... 439/862
2005/0233606 A1 * 10/2005 Lee et al. ..... 439/66

* cited by examiner

*Primary Examiner*—Gary F. Paumen
(74) *Attorney, Agent, or Firm*—Wei Te Chung

(57) ABSTRACT

A land grid array socket (10) includes a dielectric housing (12) defining a number of passages (122) and a number of conductive terminals (16) residing in the corresponding passages, respectively. Each conductive terminal includes a base section (1600) secured to the passage and a pair of opposing bent sections (162) angularly stretching out from lateral sides of the base section. The bent sections each include a resilient arm (164) protruding upwardly and obliquely out of the housing to resiliently and electrically mate with an electronic component coupled thereto.

18 Claims, 5 Drawing Sheets

LAND GRID ARRAY SOCKET

BACKGROUND OF THE INVENTION

1. Field of the Invention

The present invention generally relates to the field of electrical connectors. More particularly, one embodiment of the present invention relates to a land grid array socket for forming reliable electrical connection between a land grid array package and a circuit substrate.

2. General Background

Land grid array sockets are widely used in various electrical devices to form electrical connection between a land grid array package and a circuit substrate. Basically, a land grid array socket includes a dielectric housing defining a number of passages and a number of conductive terminals secured to the corresponding passages, respectively. The conductive terminals each include a resilient arm sticking upwardly out of the housing to mate with a land grid array package seated thereon. In use, under compression of the land grid array package, the resilient arm is deflected from its natural position and resiliently abuts against the land grid array package, thereby establishing an electrical route between the conductive terminal and the land grid array package.

The materials set forth in connection with the instant U.S. patent application describe a land grid array socket and associated conductive terminals, e.g., U.S. Pat. Nos. 6,186,797, 6,488,513 and 6,843,659, which are hereby incorporated by reference.

To obtain desirable signal-transmitting performance, each conductive terminal of the land grid array socket is required to reliably mate with the land grid array package. However, in each of the prior designs, there is only one contacting point between the land grid array package and the conductive terminal. Therefore, when the conductive terminal is accidentally biased from its normal position in the passage, electrical engagement of the conductive terminal and the land grid array package possibly cannot be ensured.

Therefore, there is a heretofore unaddressed need in the industry to address the aforementioned deficiencies and inadequacies.

SUMMARY

According to an embodiment of the present invention, a land grid array socket includes a dielectric housing defining a number of passages and a number of conductive terminals residing in corresponding passages, respectively. Each terminal includes a base section secured in the passage and a pair of opposing bent sections angled with respect to the base section. The bent sections each include a resilient arm protruding upwardly and obliquely out of the housing to electrically contact with an electronic component coupled thereto.

The embodiment of the present invention provides a land grid array socket embedded with a number of conductive terminals each having a number of resilient arms to mechanically and electrically mate with an electronic component coupled thereto. The arrangement of the resilient arms can provide multiple contacting points between the land grid array package and the conductive terminal, even though the conductive terminal may be biased from its normal position.

The present invention is illustrated by way of example and not limitation in the figures of the appended drawings, in which like references indicate identical elements, and in which:

DETAILED DESCRIPTION OF THE EMBODIMENTS

In the following description, for purpose of explanation, numerous details are set forth in order to provide a thorough understanding of the embodiments of the present invention. However, it will be apparent to one skilled in the art that these specific details are not required to practice the embodiments of the present invention.

Figure 1:
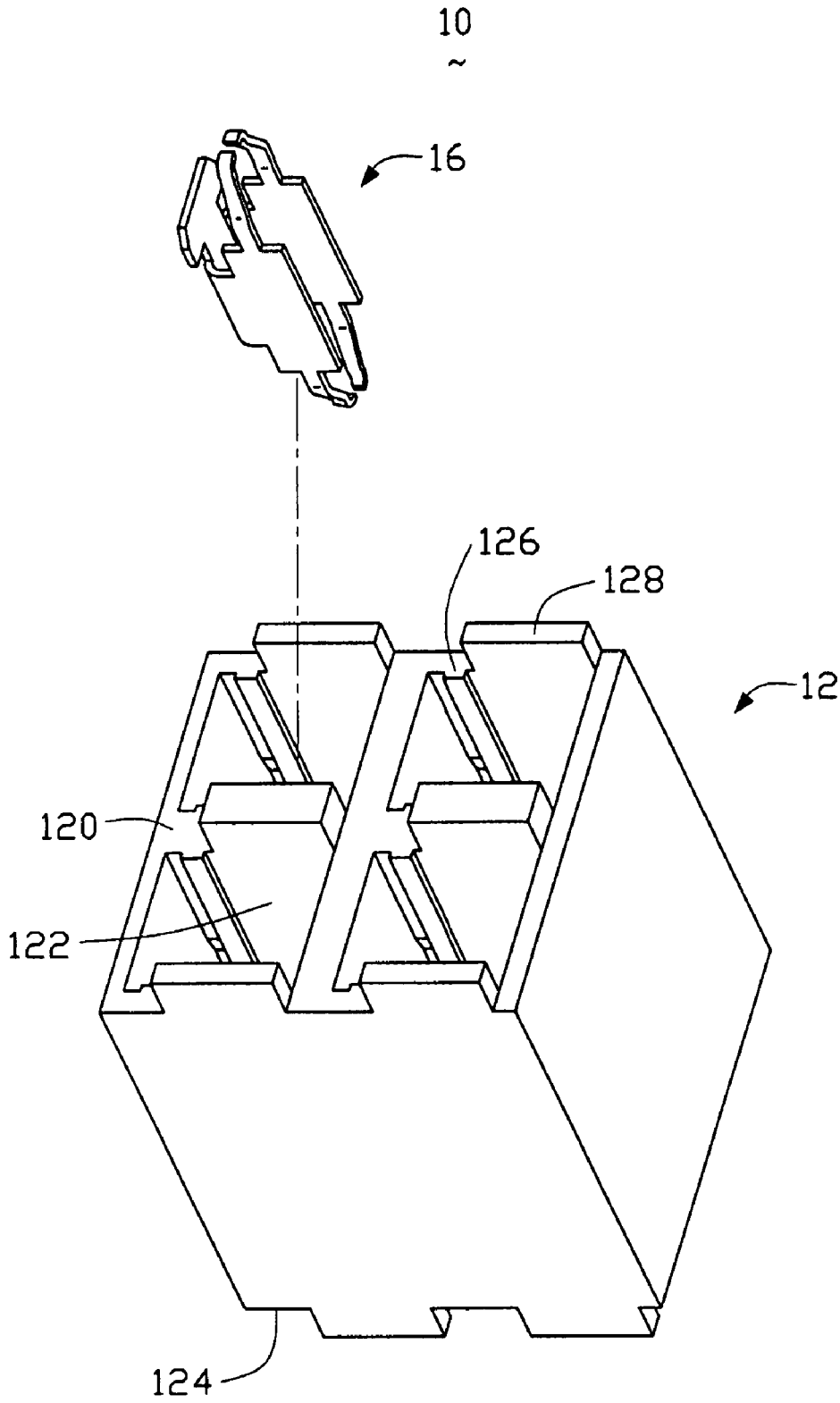
FIG. 1 depicts an exemplary isometric, exploded view of a land grid array socket according to a first embodiment of the present invention, to put it simple, only a part of the land grid array socket is shown.
Figure 2:
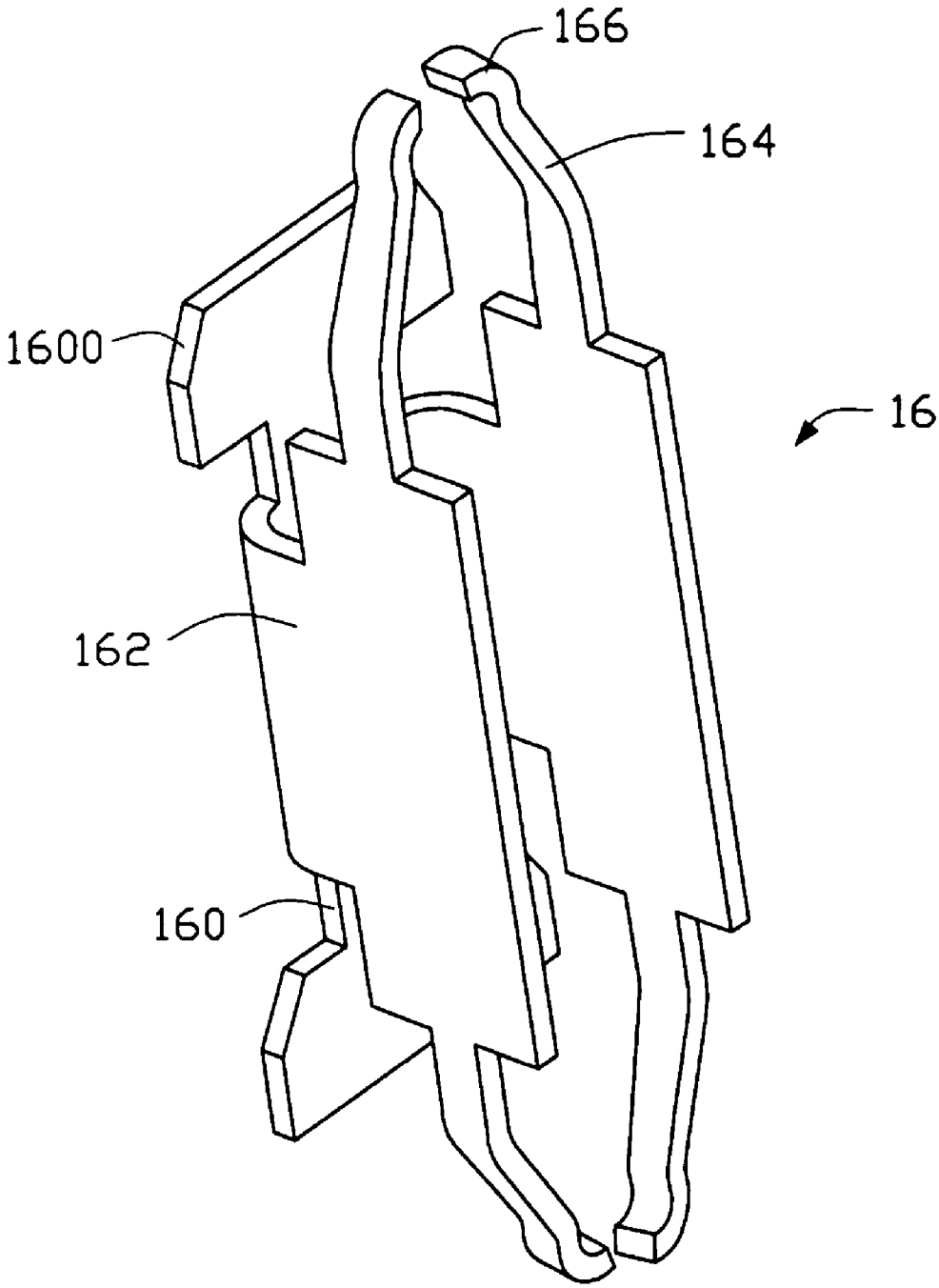
FIG. 2 depicts an exemplary enlarged view of a conductive terminal of the land grid array socket shown in FIG. 1.
Figure 3:
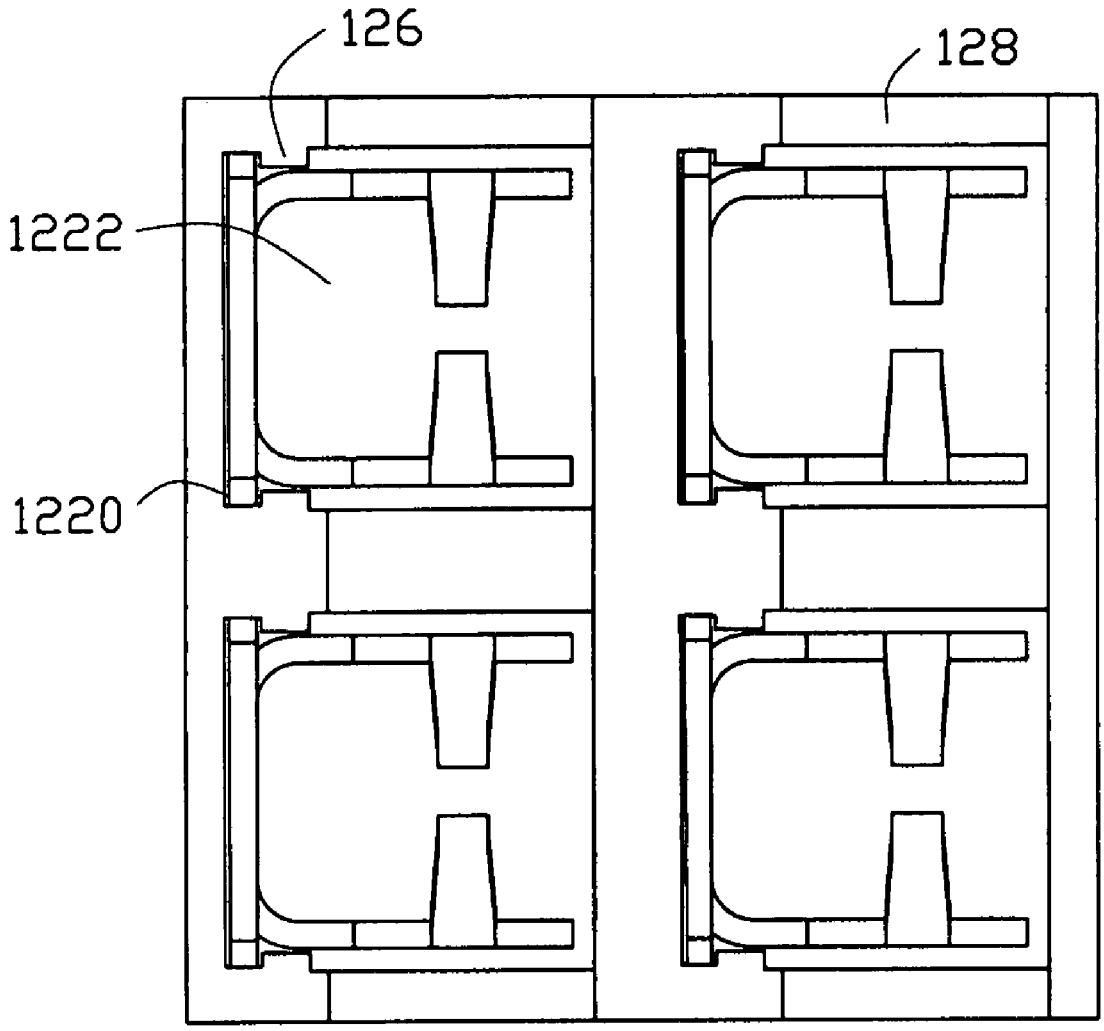
FIG. 3 depicts an exemplary assembled, plan view of the land grid array socket shown in FIG. 1.

Referring to FIG. 1 to FIG. 3, a land grid array socket 10 according to a first embodiment of the present invention includes a dielectric housing 12 defining a number of passages 122 and a number of conductive terminals 16 residing in the corresponding passages 122, respectively.

Individual elements of the land grid array socket 10 will now be described in greater detail. As shown in FIG. 1, the dielectric housing 12 includes an upper surface 120, a lower surface 124, and a number of passages 122 extending between the upper surface 120 and the lower surface 124. The housing 12 is also provided with a pair of opposite protrusions 126 extending into the passage 122 to divide the passage 122 into a narrow retaining slot 1220 and a wide receiving slot 1222 in communication with each other. The protrusion 126 can prevent the conductive terminal 16 from being biased with respect to the passage 122. In an alternative form of the present embodiment, the housing 12 is preferably formed with a number of standoffs 128. Each standoff 128 is situated between two adjacent passages 122.

As best shown in FIG. 2, the conductive terminal 16 includes a planar base section 160 and a pair of opposing bent sections 162 angularly stretching out from two lateral sides of the base section 160. The bent sections 162 each form a resilient arm 164 extending upwardly and obliquely. The resilient arms 164 of the bent sections 162 extend towards each other and are arranged in a symmetrical fashion. Each resilient arm 164 forms an arched contacting section 166 at a distal end thereof. From a plan view, distal ends of the resilient arms 164 of the opposing bent sections 162 are spaced from each other. In an alternative form of the present invention, the base section 160 is preferably formed with a number of barbs 1600 at two lateral sides thereof, so as to create reliable interferential engagement with the sidewalls of the passage 122.

When the terminal 16 is inserted in the passages 122, the base section 160 of the terminal 16 is secured in the narrow slot 1220, with the barbs 1600 interferingly engaging with the sidewalls of the narrow slot 1220. The bent sections 162 reside within the wide receiving slot 1222 and are spaced from the protrusions 126 formed on the sidewalls of the receiving slot 1222. The resilient arms 164 stick upwardly and obliquely out of the upper surface 120 of the housing 10 to electrically mate with a land grid array package (not shown) placed thereon.

Figure 4:
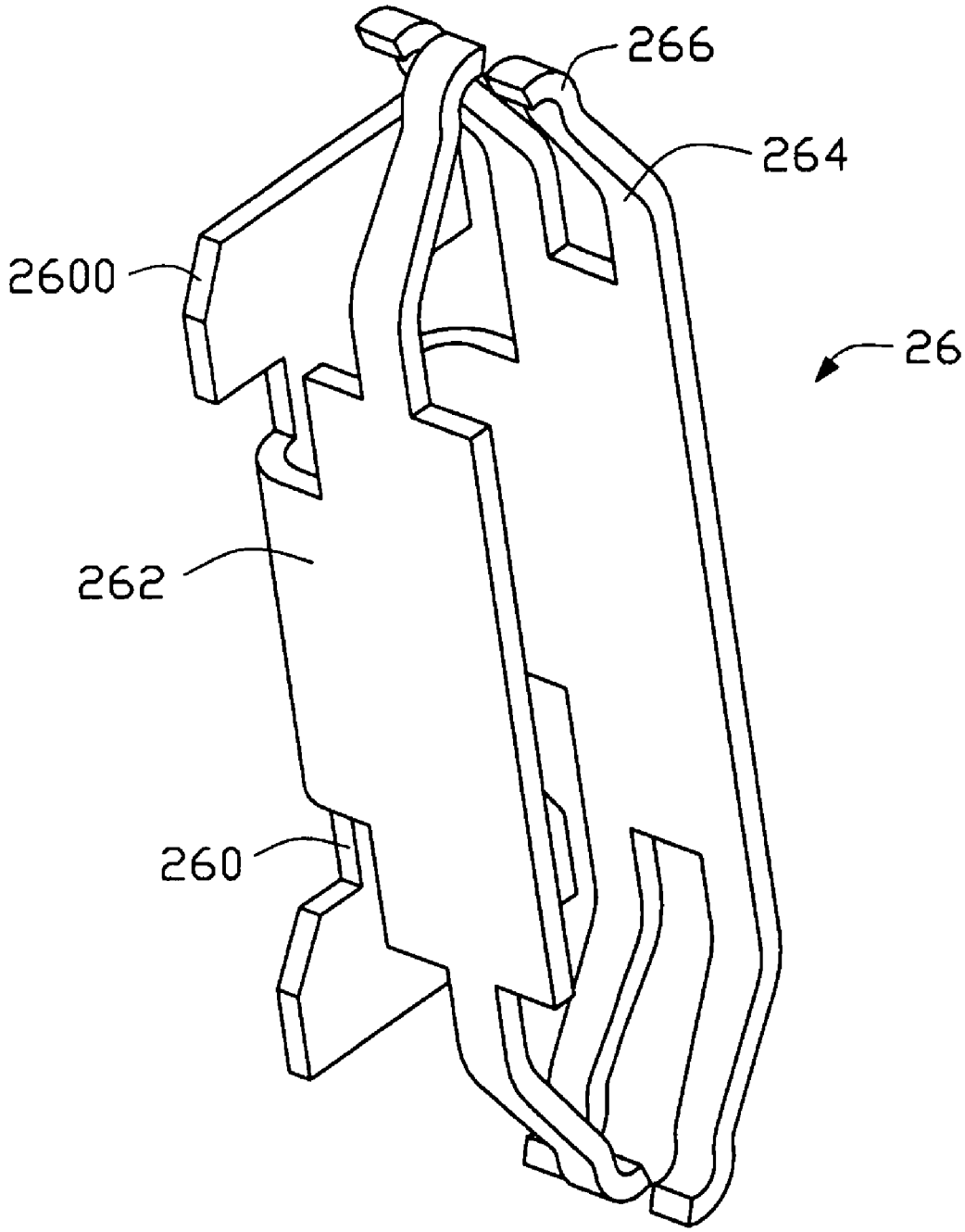
FIG. 4 depicts an exemplary isometric view of a conductive terminal for a land grid array socket in accordance with a second embodiment of the present invention.
Figure 5:
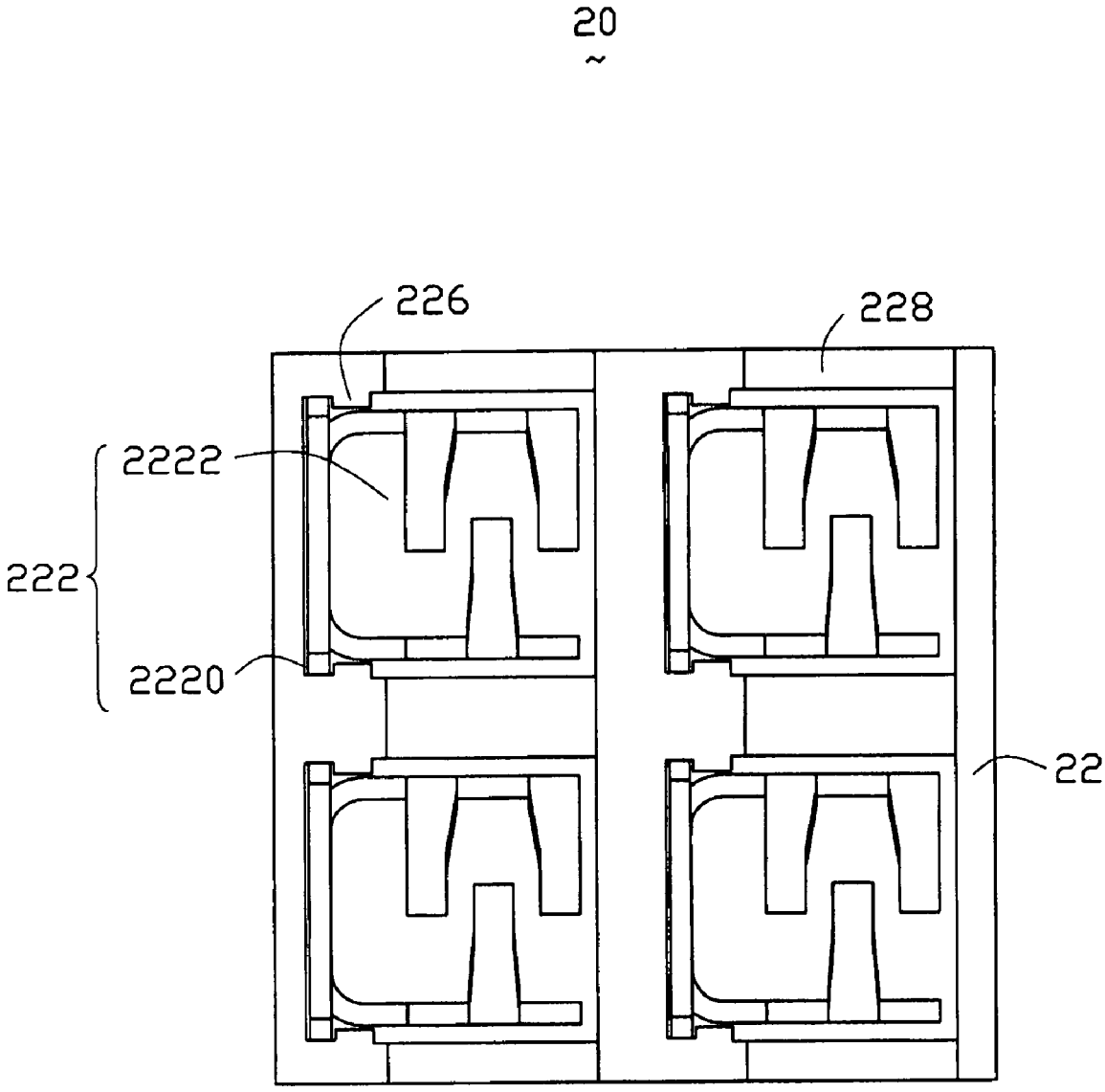
FIG. 5 is similar to FIG. 3, showing an exemplary assembled, plan view of the land grid array socket in accordance with the second embodiment of the present invention, wherein the terminals of FIG. 4 are disposed in corresponding passages, respectively.

Referring to FIG. 4 and FIG. 5, a land grid array socket 20 in accordance with a second embodiment of the present invention includes a dielectric housing 22 defining a number of passages 222 therein and a number of conductive terminals 26 received in the corresponding passages 222, respectively.

As shown in FIG. 5, the housing 22 forms a pair of opposite protrusions 226 projecting into the passage 222 and dividing the passage 222 into a narrow retaining slot 2220 and a wide receiving slot 2222 in communication with each other. In an alternative form of the present invention, the housing 22 is preferably provided with a number of standoffs 228 extending upwardly and vertically from an upper surface thereof.

As best shown in FIG. 4, the terminal 26 includes a vertically oriented planar base section 260 and a pair of opposing bent sections 262 angularly stretching out from two lateral sides of the base section 260. One bent section 262 includes a resilient arm 264. The other bent section 262 forms a pair of resilient arms 264. The resilient arms 264 of the bent sections 262 extend upwardly and obliquely towards each other. From a plan view, the resilient arms 262 are arranged in a staggered fashion. Each resilient arm 264 forms an arched contacting section 266 at a distal end thereof. In an alternative form of the present invention, the base section 260 is preferably provided with a number of barbs 2600 at two lateral sides thereof to create stable frictional interference with the sidewalls of the passage 222.

When the terminal 26 is inserted in the passages 222, the base section 260 of the terminal 26 resides in the narrow slot 2220, with the barbs 2600 thereof interferingly engaging with sidewalls of the narrow slot 2220. The bent sections 262 reside in the wide receiving slot 2222 and are spaced from the sidewalls of the receiving slot 2222. The resilient arms 264 stick upwardly and obliquely out of the housing 22 to electrically mate with a land grid array package (not shown) seated thereon.

In connection with the preceding description, the conductive terminal 16, 26 of the land grid array socket 10,20 according to the embodiments of the present invention can provide multiple contacting points to electrically mate with a land grid array package seated thereon, thereby ensuring reliable electrical connection between the conductive terminal 16,26 and the land grid array package even in the presence of deflection of the terminal 16,26.

It should be noted that, as is known in the art, the conductive terminal 16, 26 can be electrically coupled to the circuit substrate via various means known to one skilled in the art, for instance via a soldering pad, or via a pin, or via a number of spring arms as has recited in the preceding description.

While the present invention has been illustrated by description of embodiments thereof, and while the embodiments have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

The invention claimed is:

1. A land grid array socket, comprising:

a dielectric housing defining a plurality of passages; and a plurality of conductive terminals residing in corresponding passages, respectively, each terminal comprising a base section secured to the passage and a pair of opposing bent sections angled with respect to the base section, the bent sections each forming at least one resilient arm protruding upwardly and obliquely out of the housing and toward each other to electrically mate with an electronic component coupled thereto.

2. The land grid array socket of claim 1, wherein the resilient arms of the bent sections of the terminal extend toward each other and are arranged in a staggered fashion.

3. The land grid array socket of claim 1, wherein the housing is formed with a protrusion extending into the passage to divide the passage into a narrow retaining slot and a wide receiving slot in communication with each other.

4. The land grid array socket of claim 3, wherein the base section of the terminal is secured to the narrow retaining slot, and the bent sections of the terminal extend to and reside in the wide receiving slot.

5. The land grid array socket of claim 1, wherein the bent sections of the terminal are spaced from the sidewalls of the passage.

6. The land grid array socket of claim 1, wherein the at least one resilient arm of the terminal is formed with an arched contacting section at a distal end thereof.

7. The land grid array socket of claim 1, wherein each bent section of the terminal further comprises at least one resilient arm extending downwardly from a lower side thereof.

8. The land grid array socket of claim 1, wherein the housing is provided with a plurality of standoffs on at least one of an upper and a lower surfaces thereof, and each standoff is situated between two adjacent passages.

9. The land grid array socket of claim 1, wherein the resilient arms of the bent sections of the terminal are arranged in a symmetrical fashion.

10. A conductive terminal, comprising:

a planar base section, the base section being in a vertical plane; and a pair of opposing bent sections angularly stretching out from two lateral sides of the base section, each bent section forming at least one resilient arm extending upwardly and obliquely to mechanically and electrically contact with an electronic component seated thereon.

11. The conductive terminal of claim 10, wherein the resilient arms of the opposing bent sections extend toward each other and are arranged in a symmetrical fashion.

12. The conductive terminal of claim 11, wherein distal ends of the resilient arms of the opposing bent sections are spaced from each other.

13. The conductive terminal of claim 10, wherein the resilient arms of the opposing bent sections extend toward each other and are arranged in a staggered fashion.

14. The conductive terminal of claim 10, wherein the resilient arms each form an arched contacting section at a distal end thereof.

15. The conductive terminal of claim 10, wherein each bent section comprises at least one resilient arm extending downwardly and obliquely from a lower side thereof.

16. The conductive terminal of claim 10, wherein the planar base section is formed with a plurality of barbs at two lateral sides thereof.

17. An electrical connector comprising:

an insulative housing defining at least one passageway extending upwardly through an upper face of the housing;

at least one contact disposed in said passageway, said contact defining a U-shaped main body with first and second spring arms extending respectively from two opposite transverse side plates of said main body obliquely and upwardly toward each other in a transverse direction;

wherein tips of said two spring arms are located above the upper face and offset from each other along in a front-to-back direction perpendicular to said transverse direction, so as not to interfere with each other when both first and second spring arms are downwardly pressed by an electronic component mounted upon the upper face.

18. The connector as claimed in claim 17, further including a third spring arm extending from the corresponding transverse side plate beside said first spring arm with a gap in which the tip of the second spring arm is moveable without interference when all first, second and third spring arms are downwardly pressed by the electronic component.

* * * * *